United States Patent [19]

Kersey

[11] Patent Number: 4,669,196

[45] Date of Patent: Jun. 2, 1987

[54] RANGEFINDING ADJUSTABLE BOW SIGHT

[76] Inventor: Anthony E. Kersey, 1240 South Mulberry, Martinsville, Ind. 46151

[21] Appl. No.: 911,789

[22] Filed: Sep. 26, 1986

[51] Int. Cl.[4] ..... F41G 1/46

[52] U.S. Cl. ..... 33/265

[58] Field of Search ..... 33/265, 276, 277; 124/87

[56] References Cited

U.S. PATENT DOCUMENTS

| | | | |
|---|---|---|---|
| 3,854,217 | 12/1974 | Killian | 33/265 |
| 3,861,051 | 1/1975 | Killian | 33/265 |
| 3,871,105 | 3/1975 | Brougham | 33/265 |
| 3,910,700 | 10/1975 | Sprandel | 33/265 |
| 4,020,560 | 5/1977 | Heck | 33/265 |
| 4,109,390 | 8/1978 | Smith et al. | 33/265 |
| 4,153,999 | 5/1979 | O'Steen | 33/265 |
| 4,328,625 | 5/1982 | Carella | 33/265 |
| 4,481,717 | 11/1984 | Kowalski | 33/265 |
| 4,535,747 | 8/1985 | Kudlacek | 33/265 |
| 4,543,728 | 10/1985 | Kowalski | 33/265 |

*Primary Examiner*—Richard R. Stearns

*Attorney, Agent, or Firm*—Woodard, Weikart, Emhardt & Naughton

[57] ABSTRACT

A rangefinding adjustable bow sight for use with an archery bow having a mediate grip portion. A frame is adapted for rigid attachment to the bow adjacent the grip portion. A lead screw is mounted to the frame such that the axis of the lead screw is generally parallel to the length of the bow, and such that rotation of the lead screw about its axis with respect to the frame is permitted. The lead screw has a first section having a first thread pitch and a second section having a second thread pitch different from the first thread pitch. A first rangefinding pin is fixed to the frame. A second rangefinding pin is movably mounted to the frame by a follower block threadedly engaging the first section of the lead screw for moving the second rangefinding pin axially with respect to the lead screw as the lead screw is rotated. A sight pin is movably mounted to the frame by another follower block threadedly engaging the second section of the lead screw for moving the sight pin axially with respect to the lead screw as the lead screw is rotated. A manually operable disk wheel is provided for selectively rotating the lead screw about its axis in either direction. The first and second rangefinding pins and the sight pin are disposed with respect to each other such that as the distance between the first and second rangefinding pins increases, the sight pin is raised toward the top of the bow.

5 Claims, 3 Drawing Figures

RANGEFINDING ADJUSTABLE BOW SIGHT

BACKGROUND OF THE INVENTION

The present invention relates to sights for archery bows which are adjustable according to the range of the target, and in particular to a bow sight having a rangefinding means which automatically adjusts the sight in accordance with the range determined.

As is well known among bow hunters, in order for the arrow to hit the desired target the arrow must be aimed above the target when released, due to the influence of gravity on the arrow in flight. All other factors being equal, the farther away the target, the higher above the target the arrow must be aimed, within the practical range of the given bow and arrow combination. It is a common practice to provide sight pins spaced vertically with respect to each other and fixed to the midportion of the bow. The placement and spacing between the pins is calibrated to the particular bow and its recommended weight arrow, such that each sight pin corresponds to a particular target range, such as 20 yards, 30 yards, 40 yards, etc. The hunter upon selecting his target must estimate from his experience the range of the target, then sight the target on the proper sight pin which corresponds to his range estimate. This system, while a distinct improvement over "eyeballing" the sighting without benefit of reference sights, suffers from inherent inaccuracy due to the requirement of estimating the range, and even when the range has been estimated correctly, there is a great likelihood of sighting on the wrong pin in one's haste to get the shot off before the target escapes.

A known improvement over the above described sighting system involves single adjustable sight pin which is vertically movable the pin being set according to vertically spaced indicia on the midportion of the bow each of which corresponds to a particular range. This system eliminates the possibility of error by sighting on the wrong pin, as there is only one, but retains the inaccuracy inherent in estimating the range in the first instance.

There has therefore arisen a need for an adjustable bow sight incorporating a rangefinding feature for accurately determining the range, and automatically setting the sight pin in the proper location for the range determined.

SUMMARY OF THE INVENTION

A rangefinding adjustable bow sight for use with an archery bow having a mediate grip portion includes a frame adapted for rigid attachment to the bow adjacent the grip portion. A lead screw is provided having a first section and a second section, the first section having a first thread pitch and the second section having a second thread pitch different from the first thread pitch. A first means for mounting the lead screw to the frame is provided such that the axis of the lead screw is generally parallel to the length of the bow, and such that rotation of the lead screw about its axis with respect to the frame is permitted. A first rangefinding pin is fixed to the frame. A second rangefinding pin is movably mounted to the frame. A second means threadedly engages the first section of the lead screw for moving the second rangefinding pin axially with respect to the lead screw as the lead scre is rotated. A sight pin is movably mounted to the frame, and a third means threadedly engages the second section of the lead screw for moving the sight pin axially with respect to the lead screw as the lead screw is rotated. Manually operable means are provided for selectively rotating the lead screw about its axis in either direction. The first and second rangefinding pins and the sight pin are disposed with respect to each other such that as the distance between the first and second rangefinding pins increases, the sight pin is raised toward the top of the bow.

It is an object of the present invention to provide an adjustable bow sight incorporating a rangefinding feature for accurately determining the range, and automatically setting the sight pin in the proper location for the range determined.

Additional objects and advantages of the present invention will become apparent from the following descriptions.

DESCRIPTION OF THE PREFERRED EMBODIMENT

Figure 1:
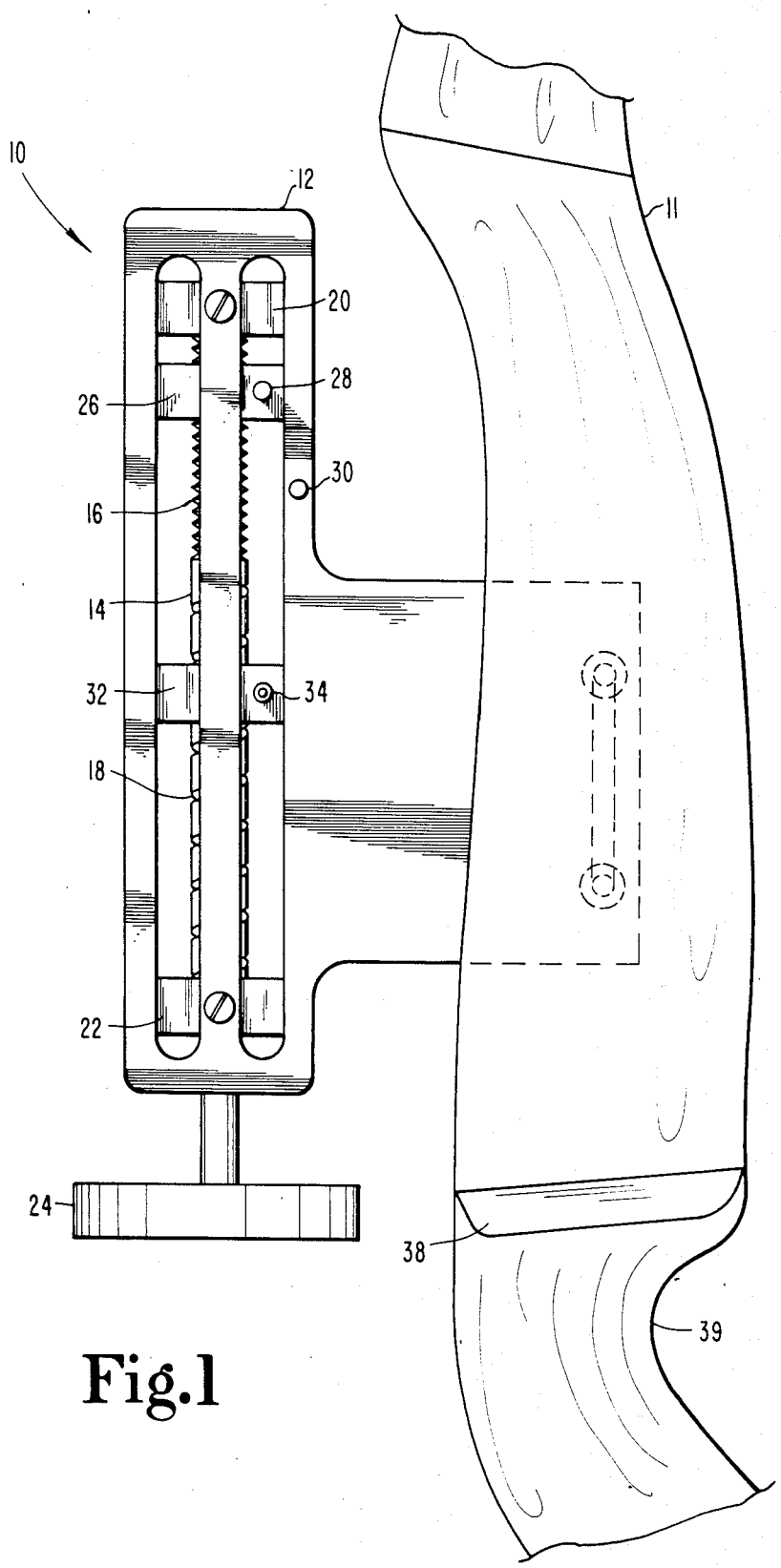
FIG. 1 is a left side elevational view of a rangefinding adjustable bow sight in accordance with the present invention, shown attached to the mediate grip portion of an archery bow.

For the purposes of promoting an understanding of the present invention, reference will now be made to the embodiment illustrated in the drawings and specific language will be used to describe the same. It is nevertheless to be understood that no limitation of the scope of the invention is thereby intended, the proper scope of the invention being indicated by the claims appended below and the equivalents thereof.

Figure 2:
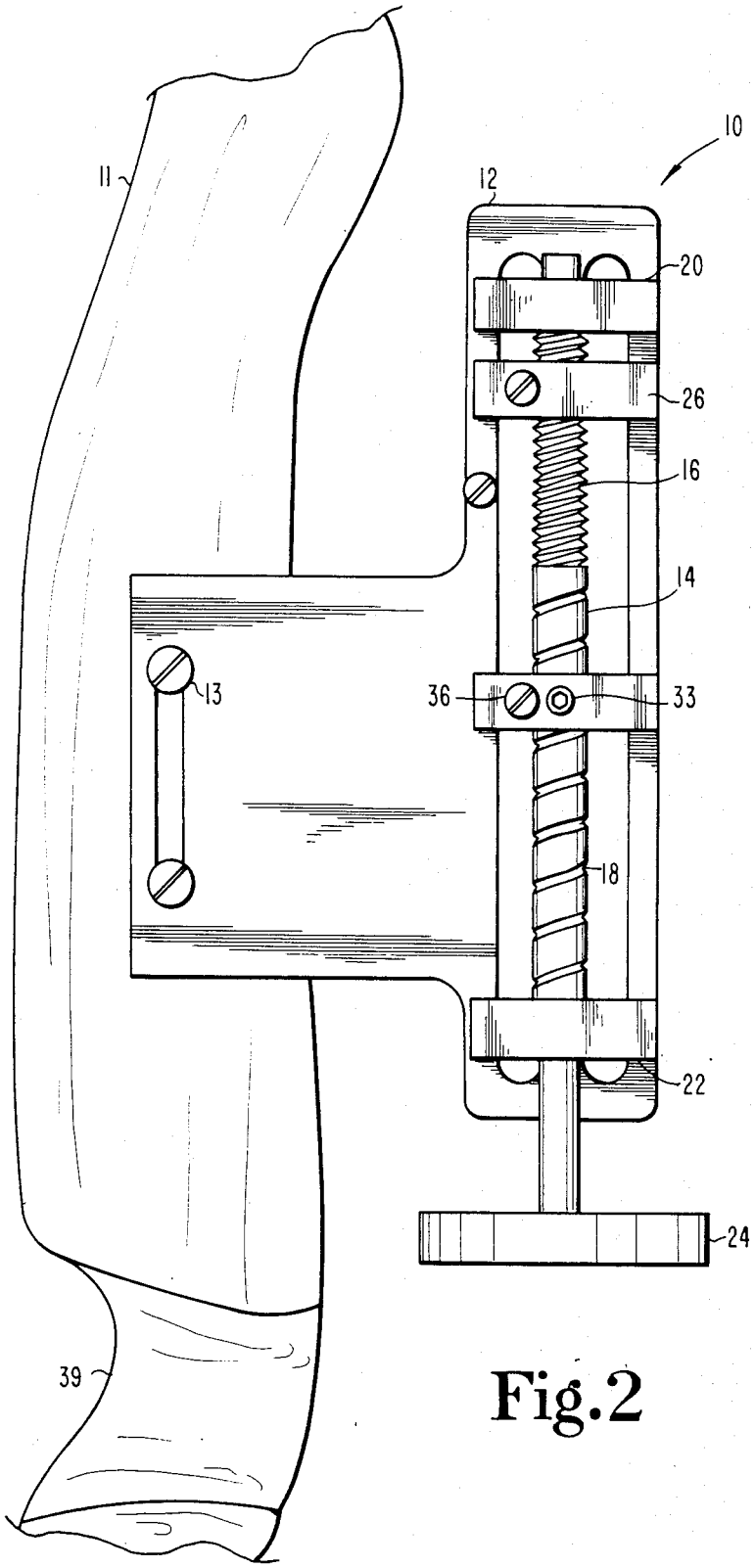
FIG. 2 is a right side elevational view of the rangefinding adjustable bow sight of FIG. 1.
Figure 3:
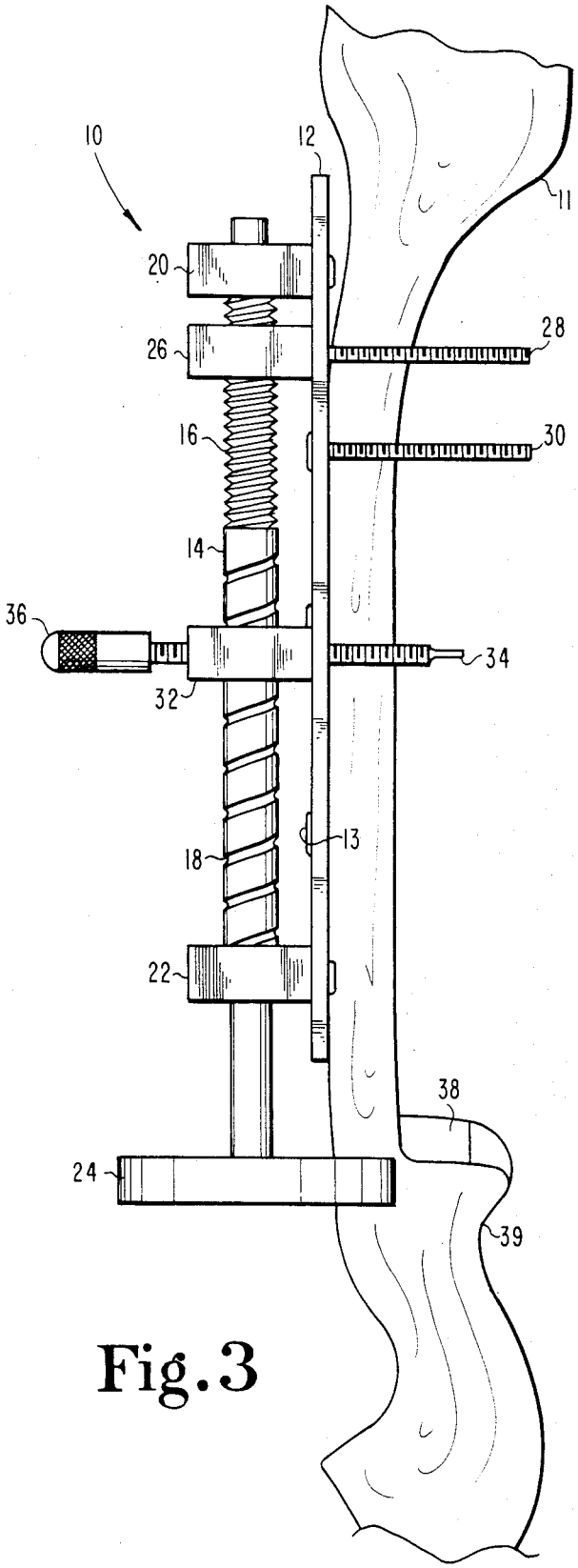
FIG. 3 is a front elevational view of the rangefinding adjustable bow sight of FIG. 1.

Referring to FIGS. 1–3, there is illustrated a rangefinding adjustable bow sight 10 in accordance with the present invention, shown attached adjacent the mediate grip portion 39 of an archery bow 11, having a conventional arrow rest 38. Bow sight 10 includes a frame 12 rigidly attached to bow 11 by screws 13 and which extends generally forwardly of bow 11. Mounted to frame 12 is a lead screw 14 oriented such that its axis of rotation is generally parallel to the length of bow 11. Lead screw 14 has two threaded sections. The first section 16 is located proximate the upper end of lead screw 14 and has a thread pitch which is different from the thread pitch of the second section 18, located proximate the lower end of lead screw 14. In particular, the thread pitch of the first section 16 is greater than the thread pitch of second section 18; that is, there are more threads per inch in first section 16 than in second section 18. The "handedness" of the threads in both sections 16 and 18 is the same.

Means are provided for mounting lead screw 14 to frame 12 to prevent axial displacement of lead screw 14 with respect to frame 12 while at the same time permitting rotation of lead screw 14 about its own axis with respect to frame 12. In particular. such means includes the terminal end portions of lead screw 14 which are of reduced diameter compared to adjacent threaded sections 16 and 18, which terminal end portions are received through appropriately sized apertures defined by upper support block 20 and lower support block 22, respectively. Support blocks 20 and 22 are fixed to frame 12 to form, in essence, combination rotational and thrust bearings for lead screw 14. The lower terminal end portion of lead screw 14 extends downwardly below frame 12 and has coaxially fixed thereto an horizontally oriented disk 24, which serves as a manually operable means for selectively rotating lead screw 14 in either direction. Disk 24 is so positioned with respect to bow 11 that the edge of the disk can be engaged by the index finger of the left hand (assuming a right handed bow) while the bow string is drawn, and the lead screw thereby rotated as desired in accordance with the rangefinding function described below.

A follower block 26 has a vertical aperture therethrough cooperatively threaded to engage the first section 16 of lead screw 14, and block 26 slidingly engages frame 12 such that block 26 is caused to move axially with respect to lead screw 14 as lead screw 14 is rotated. Whether block 26 moves upwardly or downwardly naturally depends upon the direction of rotation of lead screw 14. Carried by block 26 in fixed relation thereto is a rangefinding pin 28 oriented substantially perpendicular to frame 12, and consequently, substantially horizontal and perpendicular to the line of sight when the bow is held in the usual manner such that the length of the bow is substantially vertical. As block 26 is moved up and down, that is, axially with respect to lead screw 14, rangefinding pin 28 moves likewise.

Another rangefinding pin 30 is fixed to frame 12 at a location below rangefinding pin 28 and is oriented similarly thereto, such that pins 28 and 30 remain parallel to one another even as the vertical spacing between them is increased or decreased as pin 28 moves.

Another follower block 32 has a vertical aperture therethrough cooperatively threaded to engage the second section 18 of lead screw 14, and block 32 slidingly engages frame 12 such that block 32 is caused to move axially with respect to lead screw 14 as lead screw 14 is rotated, in the same manner as described for block 26, above. Due to the different thread pitch of section 18, which is actually more in the nature of a spiral groove, the cooperative threading of block 32 in the embodiment shown herein actually comprises a single pin 33 which engages the thread groove of section 18. Alternatively, block 32 could be provided with a cooperative internal spiral ridge. Carried by block 32 is a sight pin 34 oriented, as are rangefinding pins 28 and 30, substantially perpendicular to frame 12, and consequently. substantially horizontal and perpendicular to the line of sight when the bow is held in the usual manner as described above. As can be readily appreciated from inspection of the drawings, as lead screw 14 is rotated, blocks 26 and 32, and hence rangefinding pin 28 and sight pin 34, move in the same direction, although obviously not at the same rate due to the difference in thread pitch between sections 16 and 18. Less readily apparent from the drawings is the fact that movable rangefinding pin 28 never goes below fixed rangefinding pin 30 since block 32 would first "bottom out" against lower support block 22.

Sight pin 34 is tapered to a point to provide a well defined reference point to sight upon the target, inasmuch as the bow must be horizontally aimed as well as vertically aimed. For this reason, sight pin 34 is threadedly received through block 32, to permit horizontal adjustment of sight pin 34 by way of knurled knob 36. Such adjustment is made to compensate for the peculiarities of individual shooters in the manner in which they draw and aim the bow and to correct for windage.

As a consequence of the arrangement of the rangefinding pins and the sighting pin described above, it follows that as lead screw 14 is turned so as to increase the vertical separation between rangefinding pins 28 and 30, sight pin 34 is simultaneously raised upwardly toward the top of bow 11. Conversely as lead screw 14 is turned so as to decrease the vertical separation between rangefinding pins 28 and 30, sight pin 34 is simultaneously lowered downwardly toward the bottom of bow 11.

The action of bow sight 10 just described enables the sight pin 34 to be automatically adjusted to the proper position as the range of the target is automatically determined, by taking advantage of the principal of parallax, via the rangefinding pins 28 and 30. The hunter simply draws the bow and aims in the general direction of the target, sighting the target between the rangefinding pins 28 and 30. He then turns disk 24 in the appropriate direction until the top rangefinding pin 28 is aligned with the top of the target while the bottom rangefinding pin 30 is simultaneously aligned with the bottom of the target. He then moves the bow such that the sight pin 34 is aligned on the target and lets loose the arrow.

The farther away is the target the smaller it will appear. Hence the rangefinding pins will be moved closer together, causing the sight pin to be lowered, which in turn will result in the bow being tilted up higher as the sight pin is aligned with the target, and consequently when the arrow is released, its trajectory is higher allowing it to fly farther and hit the intended target. With closer targets the action is reversed.

It must be recognized that the ratio of the thread pitches between section 16 and 18 of lead screw 14 is central to the accurate operation of the system, and will vary according to the type of bow and arrow used and the size of the intended target. The embodiment shown herein was designed for deer hunting, assuming an average deer body height from back to belly of 14½ inches. If the intended target were larger or smaller, the thread pitch ratio would have to be changed. Nevertheless, the proper ratio can be fairly easily determined experimentally. The first step for a given bow/arrow combination would be to determine the proper placement of the sight pin for each of a series of ranges, such as 20 yards, 30 yards, 40 yards, etc. It will be found that within the practical range of the bow/arrow combination, the spacing between the sight pin locations for the various yardages will be close to linear. Next, the difference in spacing between the rangefinding pins at the longest and shortest yardages should be determined for a target of a selected size. The ratio of the latter difference in spacing to the difference in spacing between the sight pins at the longest and shortest yardage will determine the proper thread ratio for the two sections of the lead screw.

While the preferred embodiment of the invention has been illustrated and described in some detail in the drawings and foregoing description, it is to be understood that this description is made only by way of example to set forth the best mode contemplated of carrying out the invention and not as a limitation to the scope of the invention which is pointed out in the claims below.

What is claimed is:

1. A rangefindinq adjustable bow sight for use with an archery bow having a mediate grip portion, comprising:

a frame adapted for rigid attachment to said bow adjacent the grip portion thereof;

a lead screw having a first section and a second section, the first section having a first thread pitch and the second section having a second thread pitch different from the first thread pitch;

first means for mounting said lead screw to said frame such that the axis of said lead screw is generally parallel to the length of said bow, and for permitting rotation of said lead screw about its axis with respect to said frame;

a first rangefinding pin fixed to said frame;

a second rangefinding pin movably mounted to said frame;

second means threadedly engaging the first section of said lead screw for moving said second rangefinding pin axially with respect to said lead screw as said lead screw is rotated;

a sight pin movably mounted to said frame;

third means threadedly engaging the second section of said lead screw for moving said sight pin axially with respect to said lead screw as said lead screw is rotated;

manually operable means for selectively rotating said lead screw about its axis in either direction;

said first and second rangefinding pins and said sight pin being disposed with respect to each other such that as the distanoe between the first and second rangefinding pins increases, said sight pin is raised toward the top of said bow.

2. The rangefinding adjustable bow sight of claim 1, and further including means for preventing axial displacement of said lead screw with respect to said frame.

3. The rangefinding adjustable bow sight of claim 2, in which said second means includes a follower block in sliding engagement with said frame and carrying said second rangefinding pin in fixed relationship to the follower block of said second means and said third means includes a follower block in sliding engagement with said frame and carrying said sight pin.

4. The rangefinding adjustable bow sight of claim 2, in which the thread pitch of the first section of said lead screw is greater than the thread pitch of the second section of said lead screw.

5. The rangefinding adjustable bow sight of claim 4, in which said second rangefinding pin is disposed above said first rangefinding pin, and said sight pin is disposed below said first rangefinding pin.

* * * * *